US006378532B1

(12) United States Patent
Chou et al.

(10) Patent No.: US 6,378,532 B1
(45) Date of Patent: Apr. 30, 2002

(54) HAIR CLIP STRUCTURE

(75) Inventors: Kuo-Hua Chou; Chi-Feng Chou, both of Taipei Hsien (TW)

(73) Assignee: Cha Chou Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 09/891,283

(22) Filed: Jun. 27, 2001

(51) Int. Cl.[7] ..... A45D 8/22; A45D 8/20
(52) U.S. Cl. ..... 132/279; 132/278; 132/277
(58) Field of Search ..... 132/279, 278, 132/277, 276

(56) References Cited

U.S. PATENT DOCUMENTS 5,365,955 A * 11/1994 Desgroux et al. ..... 132/279
5,445,170 A * 8/1995 Yasuda ..... 132/279
6,311,700 B1 * 11/2001 Yeh ..... 132/279

* cited by examiner

*Primary Examiner*—John J. Wilson
*Assistant Examiner*—Robyn Kieu Doan
(74) *Attorney, Agent, or Firm*—Troxell Law Office PLLC

(57) ABSTRACT

The present invention relates to an improved hair clip structure, mainly comprising a base plate which has an elastic middle bracket and an upper clipping plate at one end, and a elastic middle bracket and an upper clipping plate being coupled together the other end, and a first latching member and a second latching member being disposed at the position proximate to their coupling position, such that the curved surface at the middle section of the middle elastic bracket generates a more definite and significant curvature change by the fixing of the first latching member and the second latching member in position when the upper clipping plate and the base plate are clipped, and further prevents the hair clip from being fallen off.

13 Claims, 10 Drawing Sheets

HAIR CLIP STRUCTURE

BACKGROUND OF THE INVENTION

1. Field of the Invention

The present invention relates to an improved hair clip structure, mainly comprising a base plate which has an elastic middle bracket and an upper clipping plate at one end, and an elastic middle bracket and an upper clipping plate being coupled together the other end, and a first latching member and a second latching member being disposed at the position proximate to their coupling position, such that the curved surface at the middle section of the elastic middle bracket generates a more definite and significant curvature change by the fixing of the first latching member and the second latching member in position when the upper clipping plate and the base plate are clipped.

2. Description of the Related Art

Please refer to FIGS. 10 and 11 for the traditional hair clip, which includes a base plate 7, an upper clipping plate 8 and a middle bracket 9, and the number of hair clipped by the hair clip of this type depends on the only space that the upper clipping plate 8 and the base plate 7. In addition, when the hair pushes the middle bracket 9, both ends of the hair clip move sideways, and the middle section of the middle bracket 9 is lowered. Therefore, when the prior art hair clip is in use, the hair is clipped by means of the pressure between the middle bracket 9 and the upper clipping plate 8. However, this kind of design suits better for the clipping lots of hair. When it comes to lesser hair, the pressure at the middle bracket 9 is not sufficient to hold the hair and let the hair clip fall out of the hair, and hence gives a poor clipping effect.

To resolve the above-mentioned shortcoming, an improved hair clip was invented, which is disclosed in the U.S. Pat. No. 4,976,277. The hair clip has a base 100, and a corresponding bracket 101 being disposed at an end of the base 100, and a hook 102 being extended inward is disposed on the bracket 101, and a supporting frame 103 being disposed at the other end, and such supporting frame 103 has a corresponding coupling hole 104, which is coupled to an upper plate 110. An outwardly protruded axial section 111 is disposed on each of the both sides on an end of the upper plate 110, and the axial section 111 just passes through the coupling hole 104 so that the other end of the upper plate 111 is capable of having the open and closed positions, and a curved elastic middle bracket 120 being disposed between the upper plate 110 and the base 100. Both sides of an end of the elastic middle bracket 120 has a arc-shaped protruding ear 121 and a latching plate 122 being extended from the middle of the same end towards the protruding ear 121, such that the end of the upper plate 110 having the axial section 111 can be embedded into the spaced formed by the protruding ear 121 and the latching plate 122, and the elastic middle bracket 120 can swing within certain range by using the axial section 111 of the upper plate 110 as the center. Furthermore, the opposite end to where the upper plate 110 and the elastic middle bracket 120 are coupled has corresponding holes 112, 123 but not on the same plane. When it is used, it forms the latching holes 112, 123 with a height difference on different planes according to the quantity of hair, and selects one of the holes to latch onto the hook of the bracket 101. It changes the curvature of the elastic middle bracket 120 to have an effect better than the above-mentioned hair clip. However, when the elastic middle bracket 120 is embedded into one end where the upper plate 110 and the base 100 are coupled, or directly coupled, with the upper plate 110 onto one end, the upper plate 110 is coupled with a movable method. Therefore, when the hair is clipped between the elastic middle bracket 120 and the upper plate 110, the elastic middle bracket 120 will move to one end due to the pressure on the upper plate 110 and the pushing force of the hair, and hence it cannot clip the hair securely. It is not perfect for the use when the hair clip gradually falls off from the hair.

SUMMARY OF THE INVENTION

In view of the shortcomings and poor clipping effect of the traditional hair clip as described in the previous section, the inventor of the present invention based on years of experience in the related industry conducted extensive research to enhance the structure and design of the hair clip herein which is hereby submitted for patent application.

The primary objective of the present invention is to provide an improved hair clip structure, mainly comprising a base plate which has an elastic middle bracket and an upper clipping plate at one end, and a middle elastic bracket and an upper clipping plate being coupled together the other end, and a first latching member and a second latching member being disposed at the position proximate to their coupling position, such that the curved surface at the middle section of the elastic middle bracket generates a more definite and significant curvature change by the fixing of the first latching member and the second latching member in position when the upper clipping plate and the base plate are clipped, and further prevents the hair clip from being fallen off.

Another objective of the present invention is to provide an improved hair clip structure, wherein each side of the elastic middle bracket has at least one corresponding protruded section, and a plurality of interlaced bars are disposed between the protruded section of the elastic middle bracket, thereby when the hair clip is clipped, the bars will evenly distribute the hair in the protruded section to enhance the clipping effect.

To make it easier for our examiner to understand the objective of the invention, its structure, innovative features, and its performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DETAILED DESCRIPTION OF THE PREFERRED EMBODIMENTS

Figure 1:
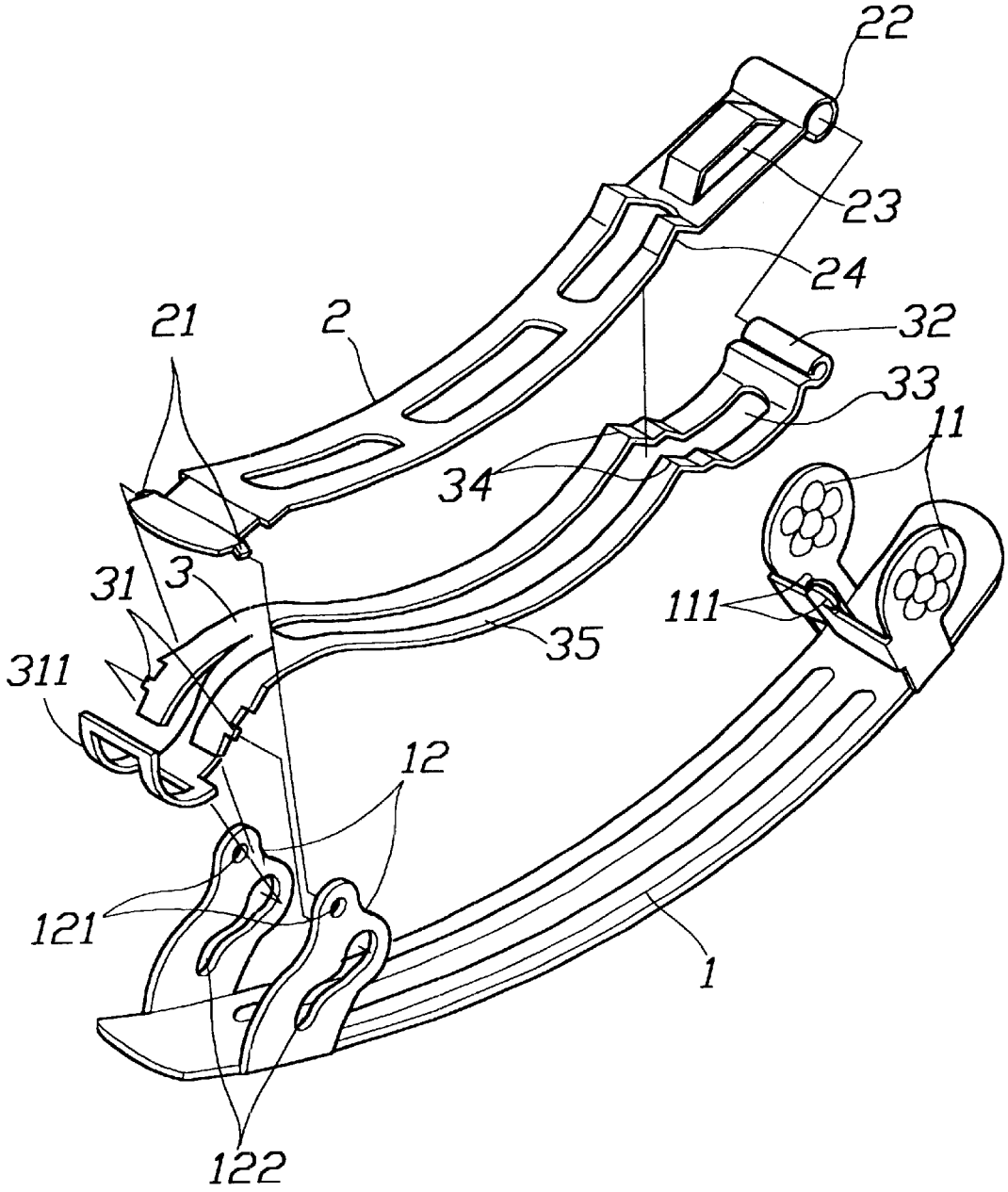
FIG. 1 shows the three-dimensional dissembled parts of the present invention.

The present invention discloses an improved hair clip structure. Please refer to FIGS. 1 and 2 which show the preferred embodiment of the present invention, and the structure comprises a base plate 1 having a corresponding pressing plate 11 each on both sides of the base plate 1, and a latching hook 111 is freely extended inward and corresponding to the pressing plate 11, and the corresponding coupling plate 12 being disposed on both sides at another end. The free end of the coupling plate 12 has a corresponding coupling hole 121, and a corresponsive sliding groove 122 being disposed at the position where the coupling holes 121 and the base plate 1 are coupled.

In addition, an upper clipping plate 2 is disposed on the base plate 1, and an axial section 21 being extended outward and disposed on both sides of an end of the upper clipping plate 2. The axial section 21 just passes through the coupling holes 121, so that it makes the upper clipping plate 2 and the base plate 1 being coupled together. A cylindrical member 22 is disposed at another end; the upper clipping plate 2 has a latching hole 23 next to the cylindrical member 22; and a first latching member 24 (which is a concavely bent section in this embodiment) is disposed next to the latching holes 23.

Furthermore, an elastic middle bracket 3 is disposed between the upper clipping plate and the base plate 1. A corresponsive sliding axis 31 is disposed on each of both sides of the elastic middle bracket 3. The sliding axis 31 is embedded into the sliding groove 122 of the base plate 1 so that the sliding axis 31 can properly move in the sliding groove 122. An arc-shaped elastic section 311 is extended outward and disposed at the end of the elastic middle bracket 3 proximate to the sliding axis 31. When it is used, the elasticity of the arc-shaped elastic section 311 keeps the elastic middle bracket 3 at the highest position of the sliding groove 122, and the other end has a cylindrical member 32 to work with the cylindrical member 22 of the upper clipping plate 2 such that end of the elastic middle bracket 3 having the cylindrical member 32 is transversally embedded into the cylindrical member 22 of the upper clipping plate 2, and is coupled to the end of the upper clipping member having the cylindrical member. Further, a latching hole 33 is disposed on the elastic middle bracket 3 at the location proximate to the cylindrical member 32, and the latching hole 33 is not on the same plane as that of the latching hole 23 on the upper clipping plate 2. A first latching member 24 and a corresponding second latching member 34 are disposed next to the latching hole 33, and the latching members are protruded sections for this embodiment. In addition, a concave arc-shaped press surface 35 is disposed at the middle section of the elastic middle bracket 3.

Figure 2:
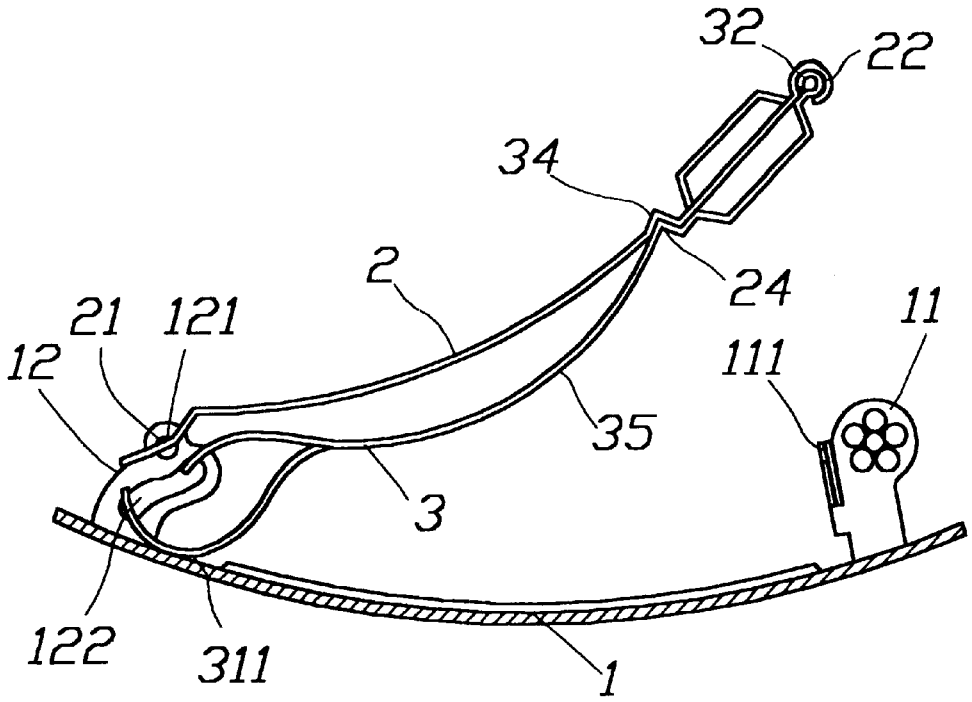
FIG. 2 is a side view diagram of the present invention when it is assembled.
Figure 3:
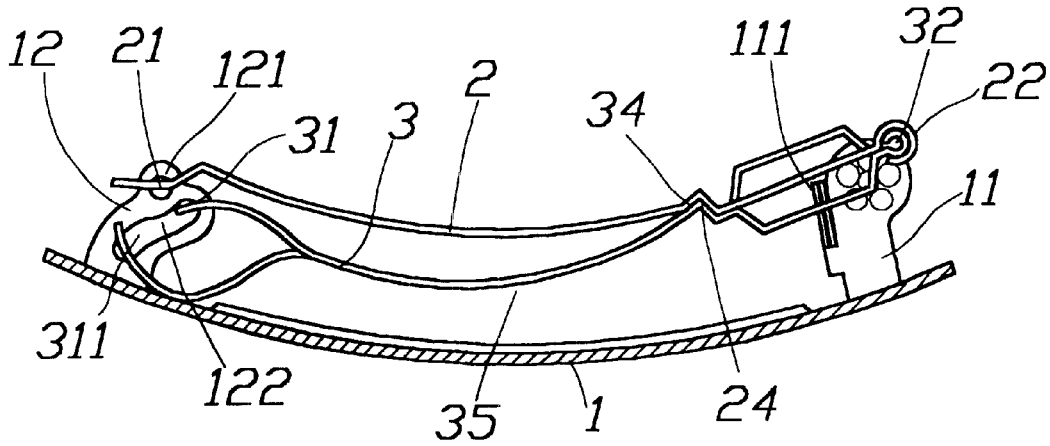
FIG. 3 is a side view diagram showing the base plate being latched into the latch hole of the elastic middle bracket according to the present invention.
Figure 4:
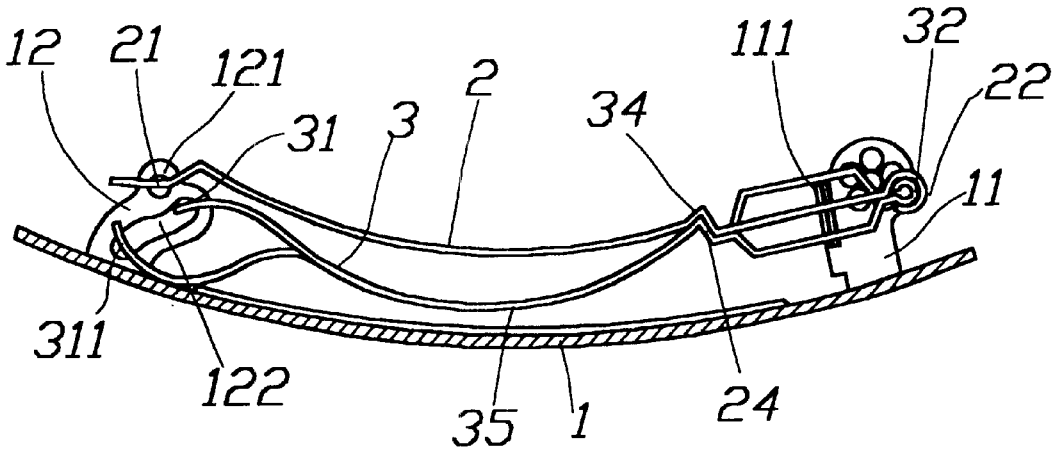
FIG. 4 is a side view diagram showing the base plate being latched into the latch hole of the upper clipping plate according to the present invention.

Please refer to FIGS. 2, 3, and 4. When the hair clip is in use, we select to use a latching hook 111 of the pressing plate 11 on one end of the base plate 1 for passing through the latching hole 23 of the upper clipping plate 2 (as shown in FIG. 4) depending on how much hair are going to be clipped, or select the latching hole 33 (as shown in FIG. 3) to generate two different clipping gaps for the upper clipping plate 2 and the base plate 1. When there is less hair, the latching hook 111 latches into a fixed position at the latching hole 23 of the upper clipping plate 2, so that the concave arc-shaped press surface 35 of the elastic middle bracket 3 forms a larger curvature and generates a bigger clipping force. On the contrary, when there is more hair, the latching hook 111 latches into the fixed position at the latching hole 33 of the elastic middle bracket 3, so that the concave arc-shaped press surface 35 of the elastic middle bracket 3 forms a smaller curvature to adopt and clip more hair in the hair clip.

Furthermore, when the upper clipping plate 2 and the base plate 1 are clipped together, the elastic middle bracket 3 by means of the elasticity of the arc-shaped elastic section 311 fixes one end of the sliding axis 31 into the highest position of the sliding groove 122; and by means of the positioning of the first latching member 24 and the second latching member 34, it fixes the end where the elastic middle bracket 3 and the upper clipping plate 2 are coupled. When the elastic middle plate 3 is pressed, it will not slide back and forth along the base plate 1 such that the curvature change generated on the concave arc-shaped press surface 35 is more definite.

Figure 5:
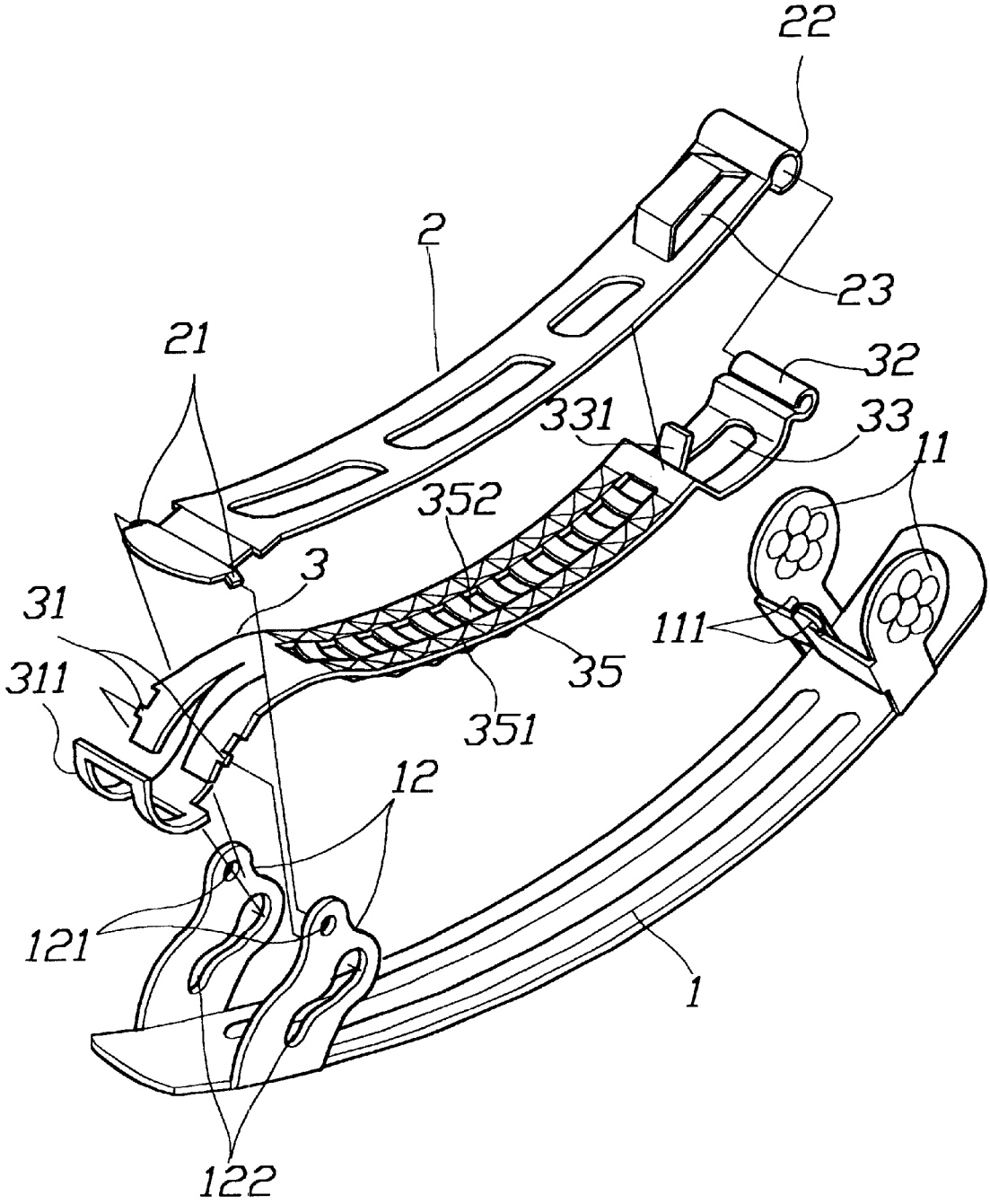
FIG. 5 shows the three-dimensional dissembled parts of another preferred embodiment of the present invention.
Figure 6:
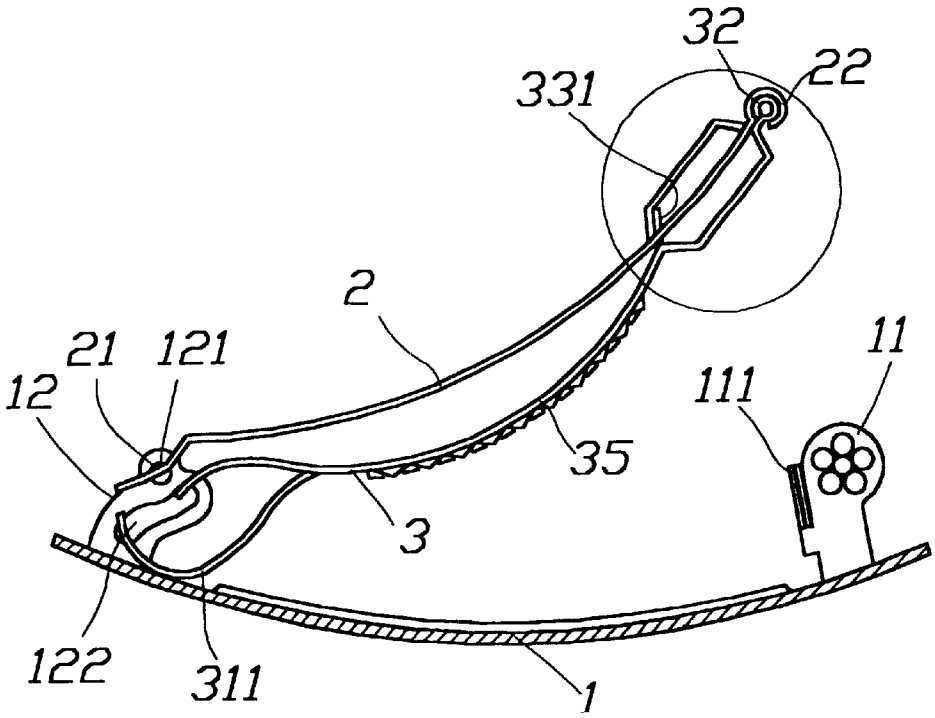
FIG. 6 is a side view diagram of another embodiment of the present invention.
Figure 7:
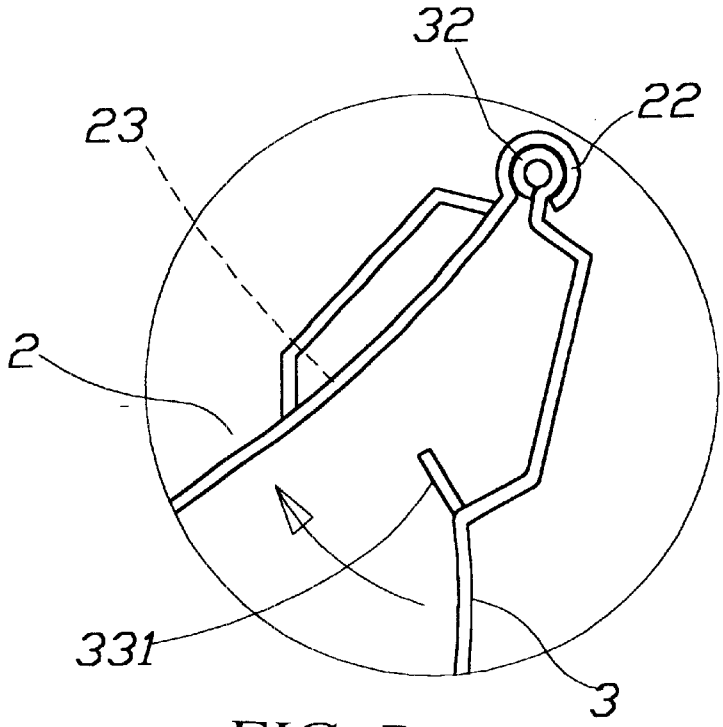
FIG. 7 is the enlarged illustrative diagram showing the end where the upper clipping plate and the elastic middle bracket are coupled according to another embodiment of the present invention.

Further, please refer to FIGS. 5, 6, and 7, which show another embodiment of the elastic middle bracket 3 of the present invention, wherein a protruding section 351 (in the shape of a cone for this embodiment) is disposed at each of the lateral sides of the concave arc-shaped press surface 35 of the elastic middle bracket 3. A hollow open groove is disposed between the protruding sections, and bars 352 which are interlaced with the protruding section 351 is disposed in the open groove. When the hair clip is clipped, the bars 352 evenly distribute the hair between the adjacent protruding sections 351 to enhance the clipping effect. In addition, a positioning convex plate 331 is formed on a side of the latching hole 33 of the elastic middle bracket 3 such that the cylindrical member 32 on one end of the elastic middle bracket 3 is transversally embedded into the coupling hole formed on the cylindrical member 22 at the end of the upper clipping plate 2. When the elastic middle bracket 3 and the upper clipping plate 2 are clipped, the elastic middle bracket 3 can be fixed in position by inserting the positioning convex plate 331 into a side of the latching hole of the upper clipping plate 2.

Figure 8:
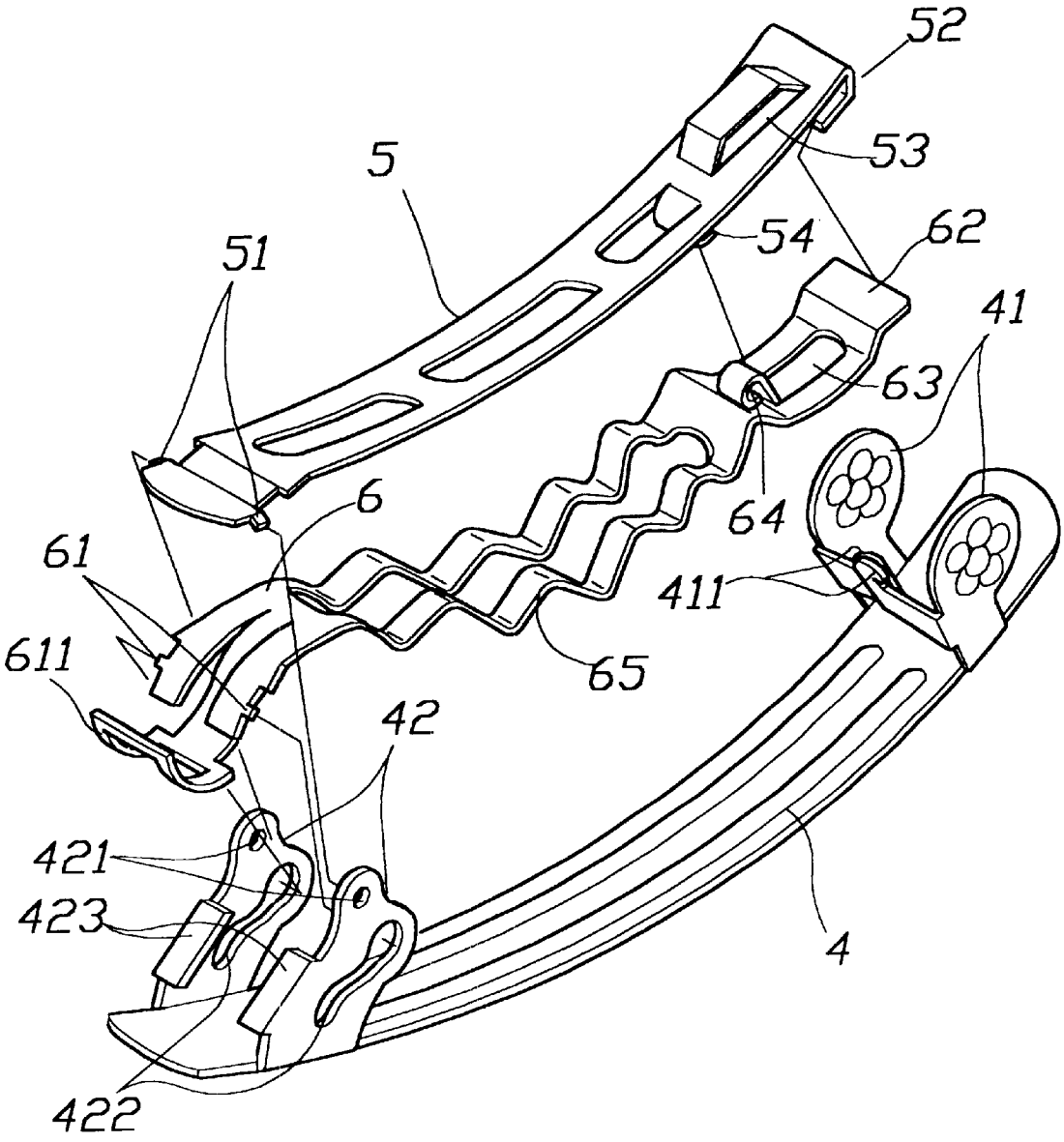
FIG. 8 shows the three-dimensional dissembled parts of another preferred embodiment of the present invention.
Figure 9:
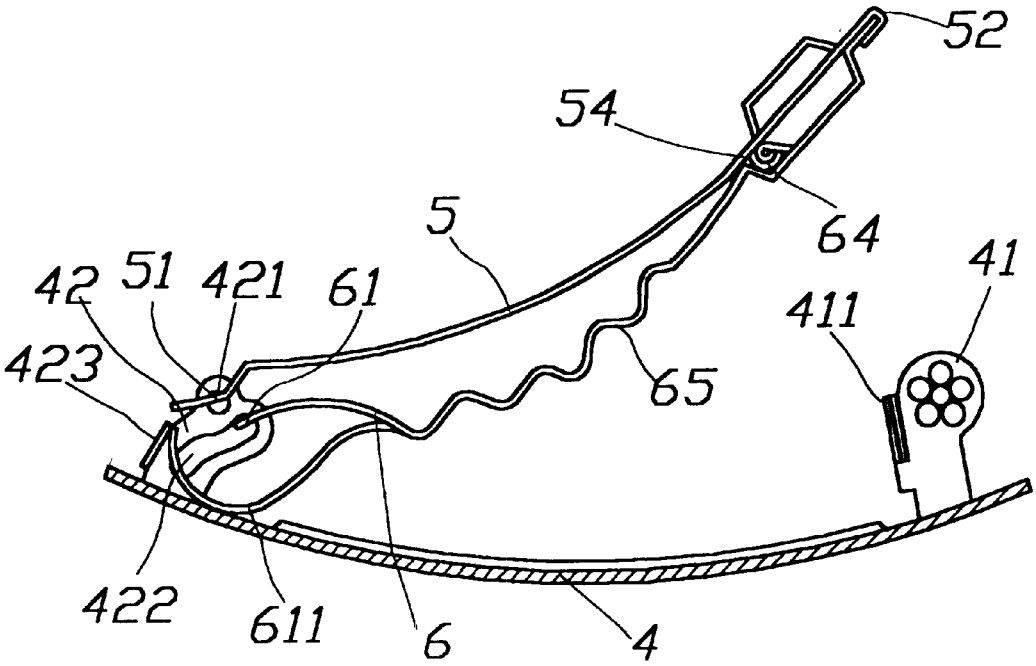
FIG. 9 is a side view diagram of another embodiment of the present invention.
Figure 10:
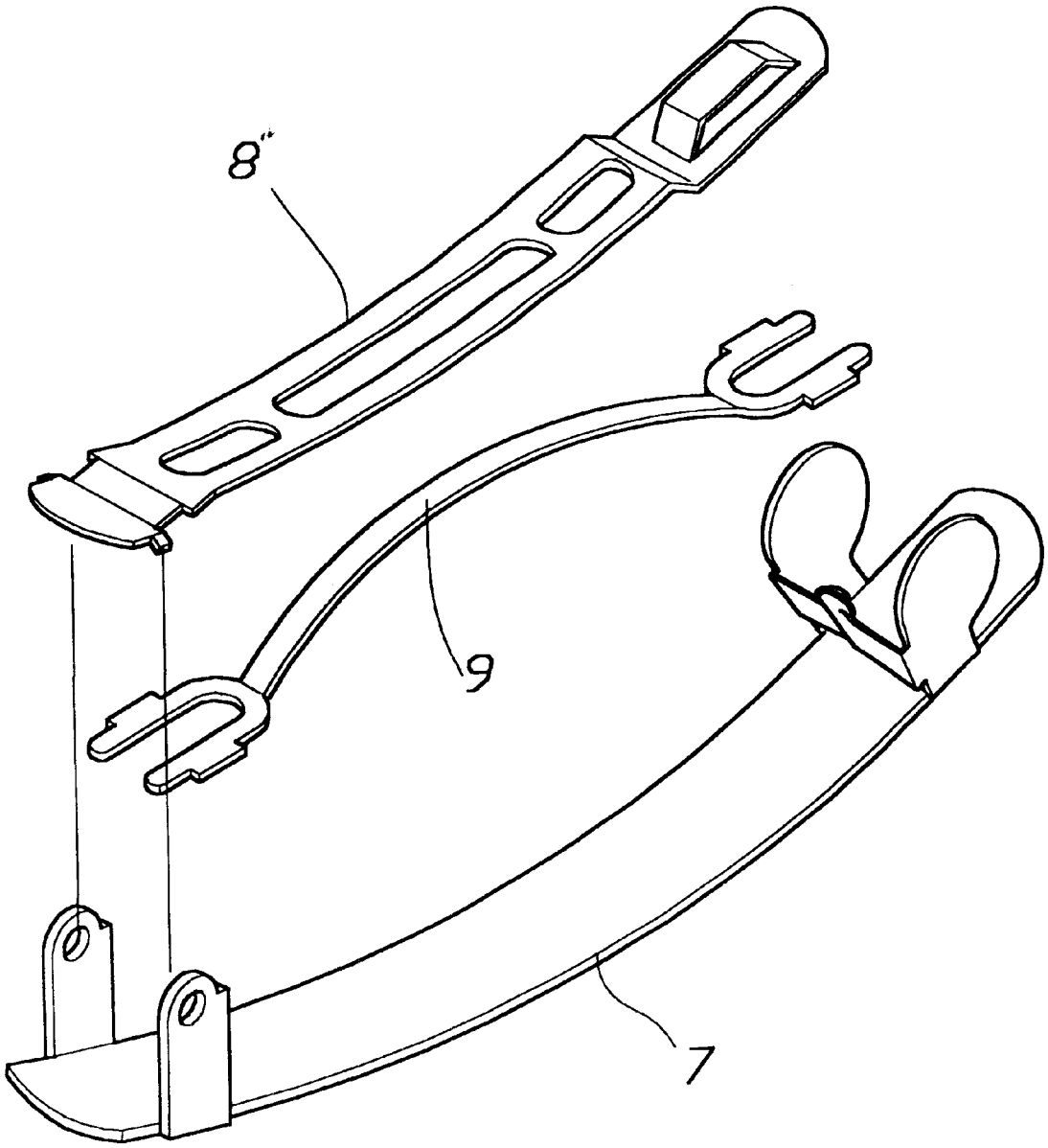
FIG. 10 PRIOR ART
FIG. 10 shows the three-dimensional dissembled parts of a prior art hair clip.
Figure 11:
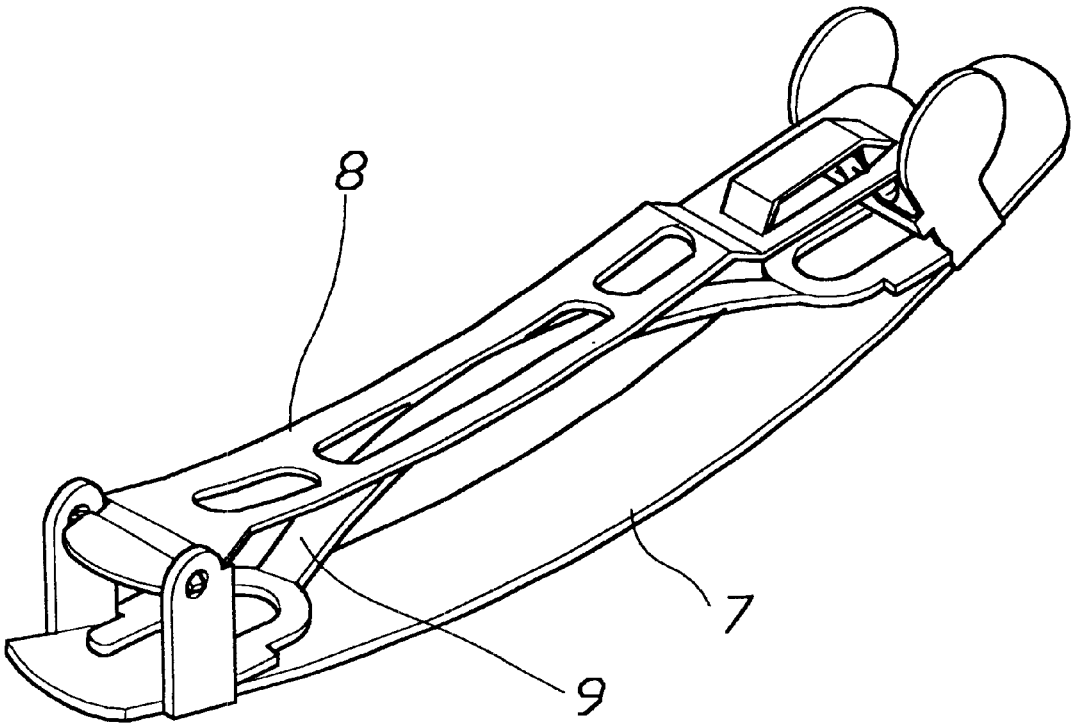
FIG. 11 PRIOR ART
FIG. 11 shows the three-dimensional assembly of a prior art hair clip.
Figure 12:
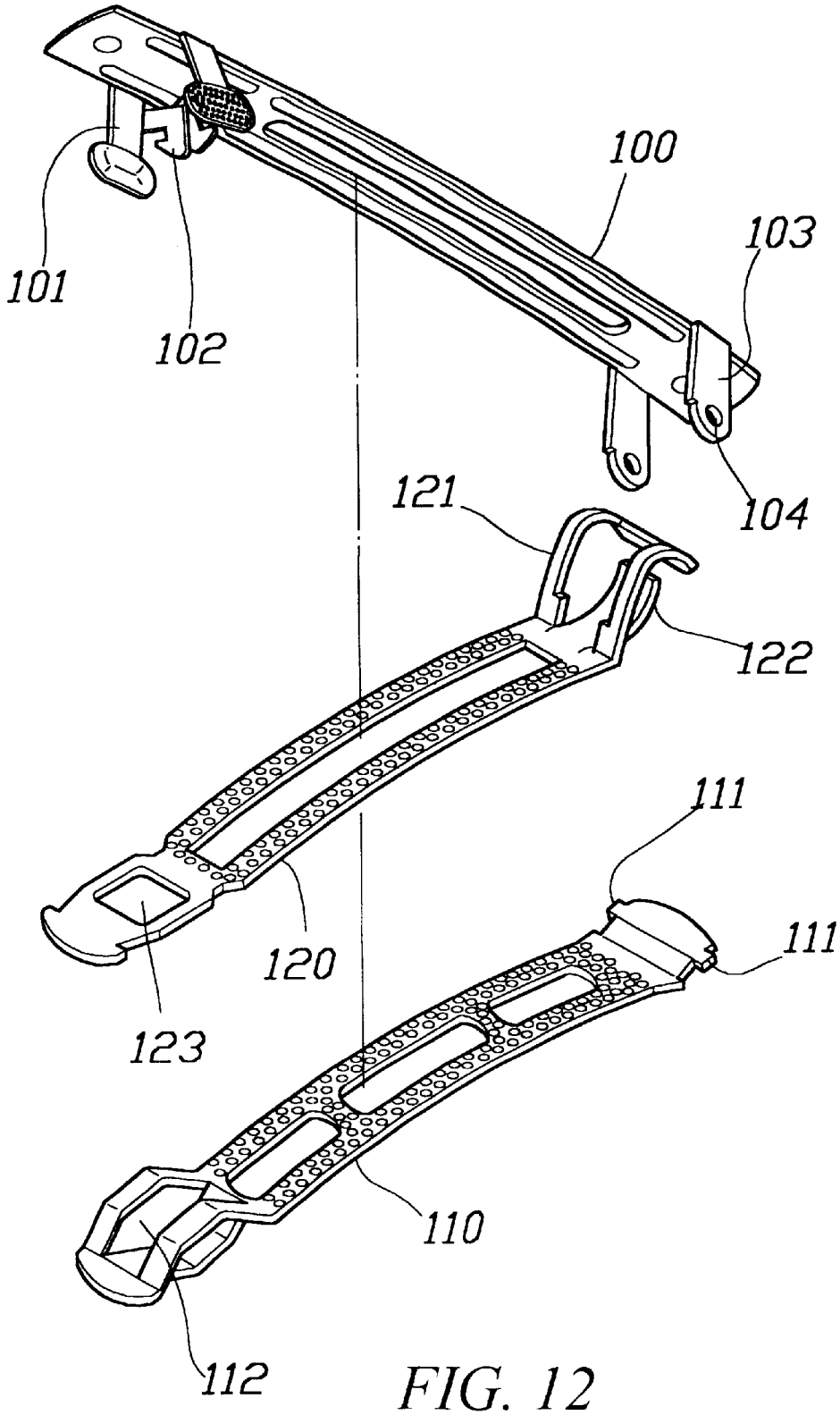
FIG. 12 PRIOR ART
FIG. 12 shows the three-dimensional dissembled parts of the hair clip according to the U.S. Pat. No. 4,976,277.

Furthermore, please refer to FIGS. 8 and 9, which show another preferred embodiment. The structure comprises a base plate 4 having a corresponding pressing plate 41 on both of its sides, and the free end of the pressing plates 41 has an inwardly extended and corresponding latching hook 411, and both sides of another end has a corresponding coupling plate 42, and the free end of the coupling plates 42 has a corresponding coupling hole 421. A corresponding sliding groove 422 is disposed between the end where the coupling holes 421 of the coupling plate 42 and the base plate 4 are connected.

Additionally, the base plate 4 has an upper clipping plate 5, and both sides of an end of the upper clipping plate 5 has an outwardly extended and corresponding axial section 51 which exactly passes through the coupling hole 421, so that the upper clipping plate 5 can be coupled with the base plate 4. A bent end 52 is disposed on the other end, and a latching hole 53 is disposed on the upper clipping plate 5 at the position proximate to the bent end 52. A first latching member 54 (which is a large cylindrical member in this embodiment) is disposed next to the latching hole 53.

Furthermore, an elastic middle bracket 6 is disposed between the upper clipping plate 5 and the,base plate 4, and a corresponding sliding axis 61 is disposed on each of the both sides of an end of the elastic middle bracket 6. The sliding axis 61 is just embedded into the sliding groove 422 of the base plate 4, so that the sliding axis 61 can move properly in the sliding groove 422. An outwardly extended arc-shaped elastic section 611 is disposed on an end of the sliding axis 61. When the hair clip is in use, the elasticity of the arc-shaped elastic section 611 will keep the elastic middle bracket 6 at the highest position of the sliding groove 422. The other end of the sliding axis 61 has an embedded end 62 which works together with the bent end 52 of the upper clipping plate 5, such that the end having the embedded end 62 of the elastic middle bracket 6 can be transversally embedded into the bent end 52 of the upper clipping plate 5 and coupled to the end having the bent end 52 of the upper clipping plate 5. Further, the elastic middle bracket 6 has a latching hole 63 at a position adjacent to the embedded end 62, and the latching hole 63 is not on the same plane with that of the latching hole 53 on the upper clipping plate 5. A first latching member 54 being disposed next to the latching hole 53 works together with a second latching member 64 (this embodiment uses a small cylindrical member). In addition, the middle section of the elastic middle bracket 6 have a wave-shaped press surface 65 such that when the elastic middle bracket 6 and the upper clipping bracket 5 are coupled, by means of the positioning effect of the first latching member 54 and the second latching member 64, the elastic middle bracket 6 and the upper clipping plate 5 can be securely coupled. When the upper clipping plate 5 and the base plate 4 are coupled, the change of the wave-shaped press surface 65 at the middle section of the elastic middle bracket 6 is more definite and secure.

Please refer to FIGS. 8 and 9. When the hair clip is in use, the user can select to pass the latching hook 411 at the pressing plate 41 on one end of the base plate 4 into the latching hole 53 of the upper clipping plate 5, or into the latching hole 63 of the elastic middle bracket 6, such that the upper clipping plate 5 and base plate 4 generate two different clipping gaps. When there is less hair, the latching hook 411 can be hooked into the latching hole 53 of the upper clipping plate 5 so that the larger curvature formed at the wave-shaped press surface 65 of the elastic middle bracket 6 generates a larger clipping force. On the contrary, when there is more hair, the latching hook 411 can be hooked into the latching hole 63 of the elastic middle bracket 6 such that the wave-shaped arced surface forms a smaller curvature and completely clips all of the hair in it.

In addition, a blocking plate 423 is disposed at the rear side of the coupling plate 42 of the base plate 4 to restrict and block the arc-shaped elastic section 611 of the elastic middle bracket 6 in order to accomplish better effect.

In summation of the above description, the present invention herein enhances the performance than the conventional structure and further complies with the patent application requirements and is submitted to the Patent and Trademark Office for review and granting of the commensurate patent rights.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An improved hair clip structure, comprising:

a base plate, each of the two sides of the base plate further comprising a corresponding pressing plate which has an inwardly extended and corresponding latching hook, and the other end of the two sides having a corresponding coupling plate which has a coupling hole and a sliding groove;

an upper clipping plate, being disposed on the base plate, and an end on both sides of the upper clipping plate has an outwardly extended and corresponding axial section which exactly passes through the coupling hole, such that the upper clipping plate and the base plate are pivotally coupled, and the other end has a latching hole and a first latching member is disposed next to the latching hole;

an elastic middle bracket, being clipped between the base plate and the upper clipping plate, having a sliding axis at an end on both sides of the elastic middle bracket, and the sliding axis is exactly embedded into the sliding groove of the base plate, so that the sliding axis can move properly in the sliding groove, and an outwardly extended arc-shaped elastic section is disposed at the end of the elastic middle bracket next to the sliding axis; when the hair clip is in use, the elastic middle bracket is kept at the highest position of the sliding groove by means of the elasticity of the arc-shaped elastic section, and the other end is coupled with the upper clipping plate by embedding, and a latching hole is disposed on the elastic middle bracket at an end proximate to where the elastic middle bracket and the upper clipping plate are coupled, and such latching hole is not in the same plane with that of the latching hole on the upper clipping plate, and such latching hole has a first latching member that works together with a second latching member;

wherein the structure composed of the foregoing elements makes the elastic middle bracket to stay in position by means of the first latching member and the second latching member when the upper clipping plate and the base plate are clipped, and attains the purpose of clipping the hair securely and prevents the hair from being fallen off and separated when the upper clipping plate and the elastic middle bracket are clipped.

2. An improved hair clip structure as claimed in claim 1, wherein said first latching member is a concave bent section.

3. An improved hair clip structure as claimed in claim 1, wherein said second latching member is a convex bent section.

4. An improved hair clip structure as claimed in claim 1, wherein said first latching member is a large cylindrical member.

5. An improved hair clip structure as claimed in claim 1, wherein said second latching member is a small cylindrical member.

6. An improved hair clip structure as claimed in claim 1, wherein said middle elastic bracket at its middle section has an arc-shaped press surface.

7. An improved hair clip structure as claimed in claim 1, wherein said middle elastic bracket at its middle section has a wave-shaped press surface.

8. An improved hair clip structure as claimed in claim 1, wherein said elastic middle bracket at each of the two sides has at least one corresponding convex section, and said elastic middle bracket has an interlaced press bar in the convex section so that when the hair clip is clipped, it enhances the clipping effect by means of evenly distributing the hair between the adjacent convex section.

9. An improved hair clip structure, comprising:

a base plate, each of the two sides of the base plate further comprising a corresponding pressing plate which has an inwardly extended and corresponding latching hook, and the other end of the two sides having a corresponding coupling plate which has a coupling hole and a sliding groove;

an upper clipping plate, being disposed on the base plate, and an end on both sides of the upper clipping plate has an outwardly extended and corresponding axial section which exactly passes through the coupling hole, such that the upper clipping plate and the base plate are pivotally coupled, and the other end has a latching hole;

an elastic middle bracket, being clipped between the base plate and the upper clipping plate, having a sliding axis at an end on both sides of the elastic middle bracket, and the sliding axis is exactly embedded into the sliding groove of the base plate, so that the sliding axis can move properly in the sliding groove, and an outwardly extended arc-shaped elastic section is disposed at the end of the elastic middle bracket next to the sliding axis; when the hair clip is in use, the elastic middle bracket is kept at the highest position of the sliding groove, and the other end is coupled with the upper clipping plate by embedding, and a latching hole is disposed on the elastic middle plate at an end proximate to where the elastic middle plate and the upper clipping plate are coupled, and such latching hole is not in the same plane with that of the latching hole on the upper clipping plate, and such latching hole has a positioning convex plate;

wherein the structure composed of the foregoing elements makes the elastic middle bracket to stay in position by means of inserting the positioning convex plate into the side of the latching hole of the upper clipping plate, and attains the purpose of clipping the hair securely and prevents the hair from being fallen off and separated when the upper clipping plate and the elastic middle bracket are clipped.

10. An improved hair clip structure as claimed in claim 9, wherein said middle elastic bracket at its middle section has an arc-shaped press surface.

11. An improved hair clip structure as claimed in claim 9, wherein said elastic middle bracket at its middle section has a wave-shaped press surface.

12. An improved hair clip structure as claimed in claim 9, wherein said elastic middle bracket at each of the two sides has at least one corresponding convex section, and said elastic middle bracket has an interlaced press bar in the convex section so that when the hair clip is clipped, it enhances the clipping effect by means of evenly distributing the hair between the adjacent convex section.

13. An improved hair clip structure as claimed in claim 9, wherein said coupling plate of the base plate at its rear side has a blocking plate each for restricting and blocking the elastic section at the end of the elastic middle bracket such that the elastic middle bracket produces a better assisting effect.

* * * * *